United States Patent [19]

Pezzoli

[11] Patent Number: 4,722,368

[45] Date of Patent: Feb. 2, 1988

[54] UNWINDING DEVICE FOR TWIN WARP BEAMS IN WEAVING LOOMS

[75] Inventor: Luigi Pezzoli, Leffe, Italy

[73] Assignee: Vamatex S.p.A., Villa Di Serio, Italy

[21] Appl. No.: 866,788

[22] Filed: May 23, 1986

[30] Foreign Application Priority Data

May 31, 1985 [IT] Italy ..... 20983 A/85

[51] Int. Cl.[4] ..... D03D 49/06

[52] U.S. Cl. ..... 139/103; 139/110; 139/114

[58] Field of Search ..... 139/100, 101, 102, 103, 139/110, 114, 115

[56] References Cited

U.S. PATENT DOCUMENTS

| | | | |
|---|---|---|---|
| 2,539,296 | 1/1951 | Clentimack | 139/103 |
| 3,147,776 | 9/1964 | Hoffman | 139/102 |
| 4,262,706 | 4/1981 | Popp et al. | 139/103 |
| 4,392,516 | 7/1983 | Goodnough | 139/115 |
| 4,546,801 | 10/1985 | Bucher et al. | 139/110 |
| 4,572,244 | 2/1986 | Kojima et al. | 139/103 |
| 4,607,666 | 8/1986 | Zwiener et al. | 139/115 |

*Primary Examiner*—Henry S. Jaudon

*Attorney, Agent, or Firm*—Young & Thompson

[57] ABSTRACT

Unwinding device for twin warp beams, with two separate unwinders, wherein the adjustment of the two unwinders (3, 4) is carried out according to the inclinations, detected by sensors (23, 24), which the two yarn carriers (5, 6) of the beams (1, 2) take up under the different tensions of the warp yarns (f).

5 Claims, 6 Drawing Figures

UNWINDING DEVICE FOR TWIN WARP BEAMS IN WEAVING LOOMS

BACKGROUND OF THE INVENTION

The present invention concerns an unwinding device for twin warp beams in weaving looms, providing important advantages in loom construction.

It is known that, in order to facilitate the warping operation in double-width weaving machines, it is often preferred to use, instead of a single warp beam, two side-by-side beams, called "twin beams". The unwinding of such beams is either carried out by a single unwinding device, equipped with a differential between the two beams, or by two separate unwinders.

Both solutions are meant to guarantee a constant equal tension for the two beams, so as to obtain a perfect working and to exhaust the two beams simultaneously. The tension should moreover be uniform and it should be possible to efficiently regulate the damping action of the yarn carriers and to easily operate any adjustments.

The solution of a single unwinder with a differential, because of the high transmission ratios and torques involved in the operation, is subject to intolerable slacks which determine oscillations in the beams and an anomalous behaviour. It is therefore not suited for application on modern weaving machines, with high performances and working at very fast speeds.

The solution with two separate unwinders is more interesting, as it reduces slacks and halves the torques, dividing them between the two unwinders. Furthermore, it provides the advantages of an easier installation of the beams, which are free from kinematic connections. Nevertheless, in its practical accomplishments known so far, also this solution is not suited for a rational application on modern looms with high speeds and performances.

The object of the present invention is to propose a modern and satisfactory solution for an unwinding device for twin beams.

SUMMARY OF THE INVENTION

For this purpose, the present invention provides an unwinding device for twin beams, with two separate unwinders, characterized in that the adjustment of the two unwinders is carried out according to the inclinations, detected by sensors, which the two yarn carriers of the beams take up under the different tensions of the warp yarns.

Preferably, in said device, the yarn carriers are carried by an oscillating bar and are mounted, with their inward ends, on ball joints allowing rotation and inclination thereof in respect of said bar, and with their outward ends on supports—rotating and tilting on ball joints—carried by levers supporting said bar and causing the oscillation thereof, calibrated return means opposing the oscillations of said levers and of said supports according to the tensions of the warp yarns; moreover, said sensors detect the position of said supports carried by the levers, in order to adjust said unwinders.

BRIEF DESCRIPTION OF THE DRAWINGS

The invention is now described in further detail with reference to the accompanying drawings, which represent preferred embodiments thereof and in which.

DESCRIPTION OF THE PREFERRED EMBODIMENTS

Figure 1:
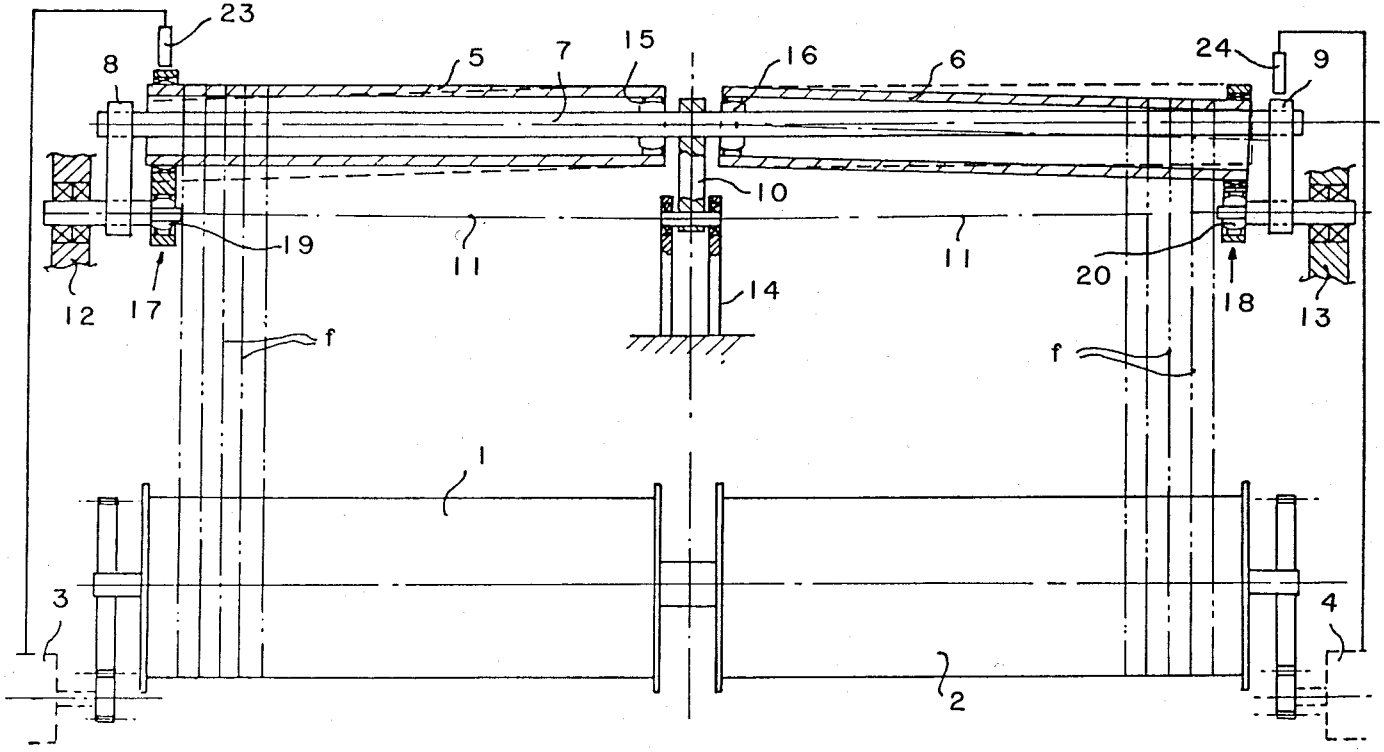
FIG. 1 is a general plan view, seen from the top, of a pair of twin warp beams with their respective yarn carriers, controlled by an unwinding device according to the invention.

The arrangement according to the invention, illustrated in FIG. 1, comprises two twin beams 1 and 2, the slow rotation of which is controlled by two separate unwinders 3 and 4, and two separate yarn carriers 5 and 6, onto which press and partially wind the warp yarns fed from the beams 1 and 2 and leading to the loom healds.

The yarn carriers 5 and 6 consist of two hollow metal rollers, mounted freely rotating and tilting on a bar 7 which is carried by two end levers 8 and 9 and by a central lever 10, said levers being mounted respectively on supports 12, 13 and 14 of the loom casing, so as to oscillate on a common axis 11.

At their inward facing ends the two yarn carriers 5 and 6 are mounted on the bar 7 by way of ball joints 15 and 16 allowing the free rotation and inclination thereof; whereas, at their outward far ends said yarn carriers are mounted on supports 17 and 18 carried by the levers 8 and 9, so as to oscillate with said levers on the axis 11; also in this case the yarn carriers are mounted by way ov ball joints 19 and 20, allowing the free rotation and inclination of the supports 17 and 18 in respect of the levers 8 and 9, and consequently the rotation of the yarn carriers and their inclination in respect of the bar 7.

Figure 3:
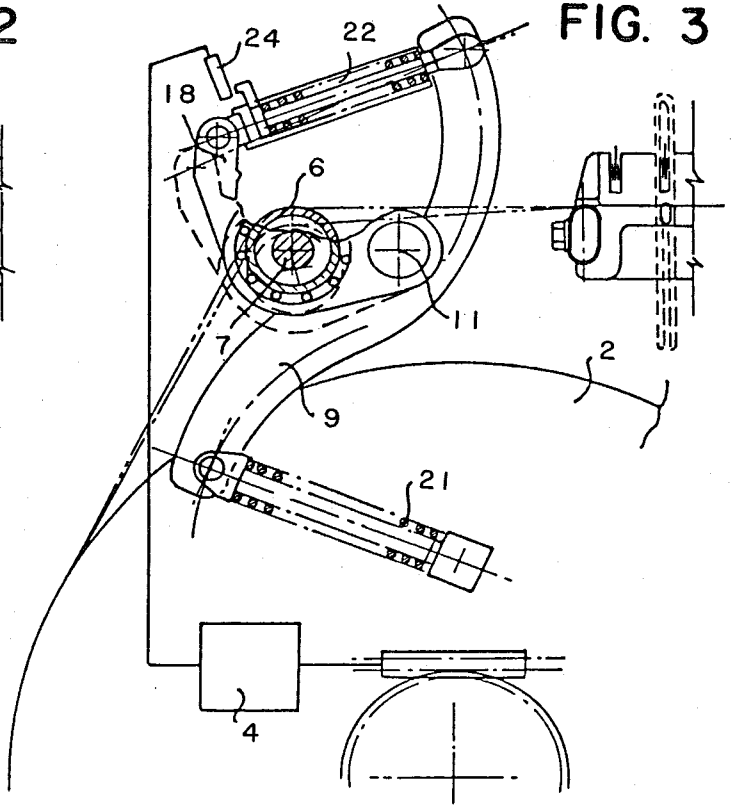
FIG. 3 is a view similar to that of FIG. 2, but showing a different working step.
Figure 2:
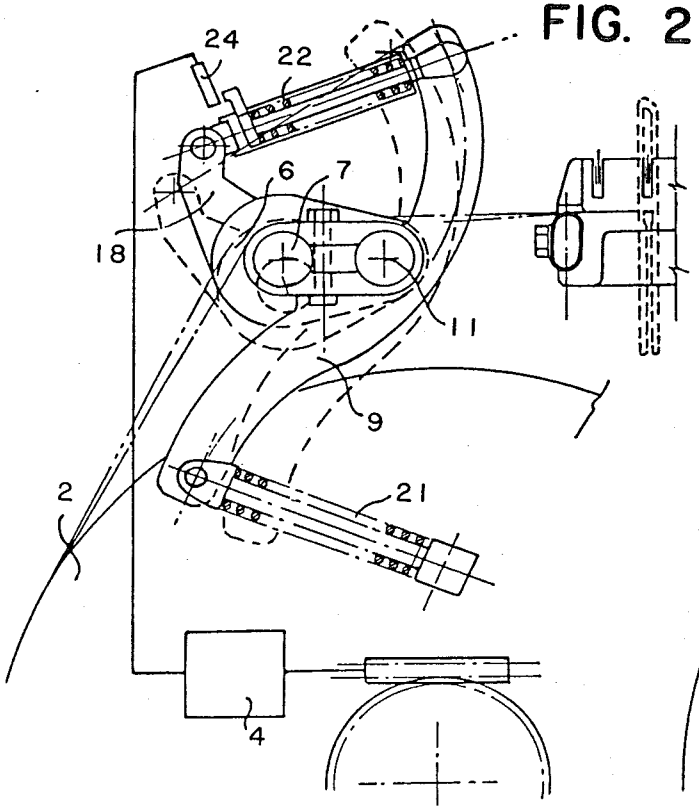
FIG. 2 is a detailed side view showing the unwinding device in a first working step.

From FIGS. 2 and 3 it appears evident that the levers 8 and 9 (only the lever 9 being shown) are stressed by return means, in the form of a spring 21, opposing the oscillations of said levers and the consequent oscillations of the bar 7 and thus of the yarn carriers 5 and 6 (only the yarn carrier 6 being shown); whereas the oscillations of the supports 17 and 18 (only the support 18 being shown), in respect of said levers 8 and 9, are in turn opposed by springs 22.

FIGS. 1 to 3 finally show sensors 23 and 24 (FIGS. 2 and 3 showing only the sensor 24) which detect the oscillations of the levers 8 and 9 and/or of the supports 17 and 18, and accordingly operate the unwinders 3 and 4 (FIGS. 2 and 3 showing only the unwinder 4).

In operation, when the shed is being formed, there is an increase in the tension of the warp yarns which overcomes the calibrated action of the return means (springs 21) and causes the counterclockwise oscillation (dashed lines in FIG. 2) of the levers 8 and 9 on the axis 11. Said oscillation is detected by the sensors 23 and 24, which provide to suitably adjust the unwinders 3 and 4.

In the event, instead, that the two twin beams 1 and 2 should unwind unevenly, thereby varying the tensions in the warp yarns pressing and winding onto the yarn carriers 5 and 6, the supports 17 and/or 18 will oscillate, and said oscillations will be detected by the sensors 23 and/or 24 so as to suitably adjust the unwinders 3 an 4. These oscillations, opposed by the springs 22, are obtained thanks to the fact that the yarn carriers 5 and 6, and the supports 17 and 18, are mounted by way of ball joints (15, 16, and respectively 19, 20).

It will thus be seen from the foregoing description and the accompanying drawings that the unwinders 3 and 4 are drives for rotating the beams 1 and 2 on which the warp yarns f are wound, and that the speed with which they rotate the beams 1 and 2 is controlled by the sensors 23 and 24. The yarn carriers 5 and 6 thus serve as tension rollers, the warp yarns f being partially trained about them and bearing thereagainst. The members 5 and 6 are freely rotatable on the ball joints 15, 16 and within ball joints carried by supports 17 and 18 that can be seen in FIG. 1.

The shape of the levers 8 and 9 is that of lever 9 as seen in FIGS. 2 and 3, mounted for rotation about axis 11 on a stub shaft which in turn is rotatable within the support 12 or 13. This stub shaft also carries the ball joint 19 or 20; and the levers 8, 9 are connected to supports 17, 18, respectively, by the springs 22 which yieldably permit relative swinging movement of 8 relative to 17 and 9 relative to 18. Springs 21 thus are compression springs which oppose counterclockwise movement of levers 8, 9, and springs 21 are likewise compression springs which oppose counterclockwise movement of 18 relative to 9 (and 17 relative to 8, not shown) all as seen in FIGS. 2 and 3.

Figure 5:
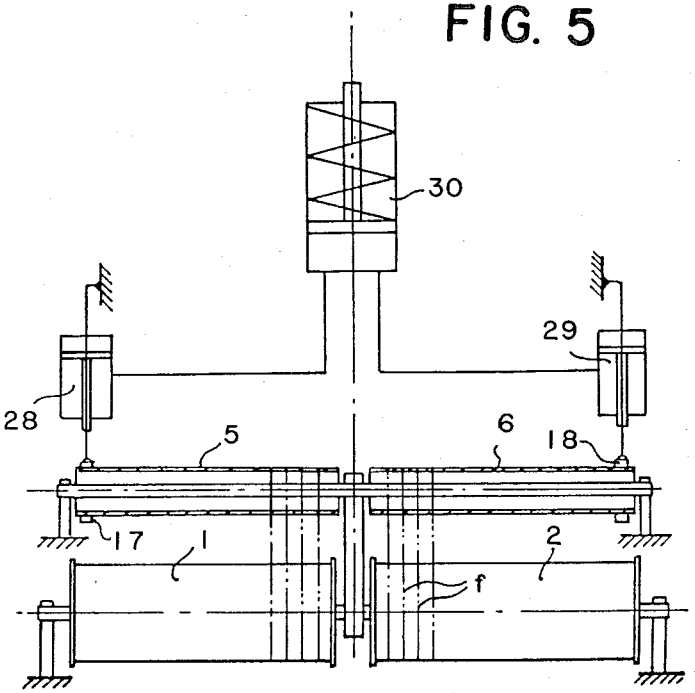
FIG. 5 shows a possible balancing connection between said return means.
Figure 4:
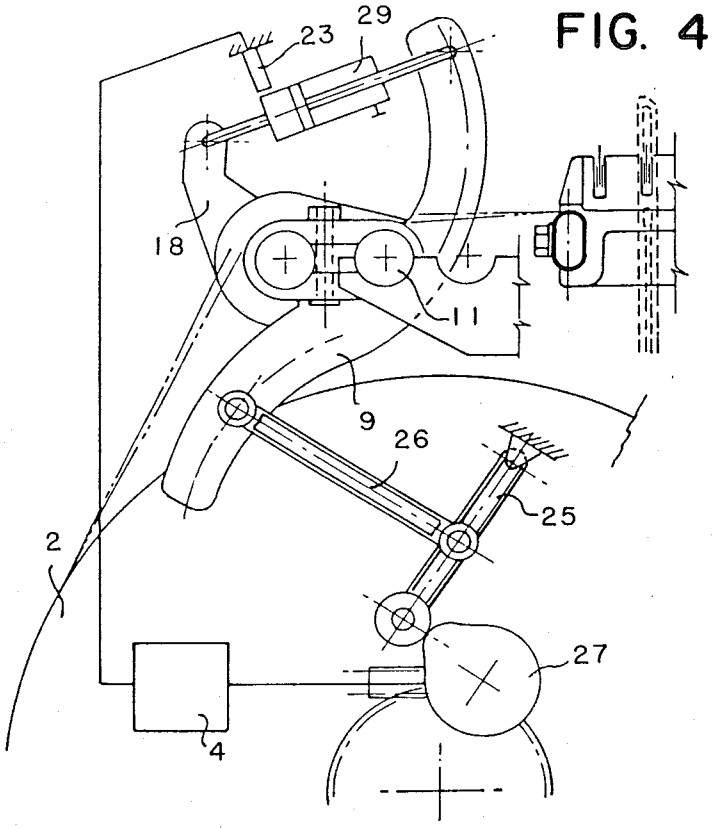
FIG. 4 shows a structural modification of the return means for the levers and for the supports of the device according to the invention, shown in the previous figures.
Figure 6:
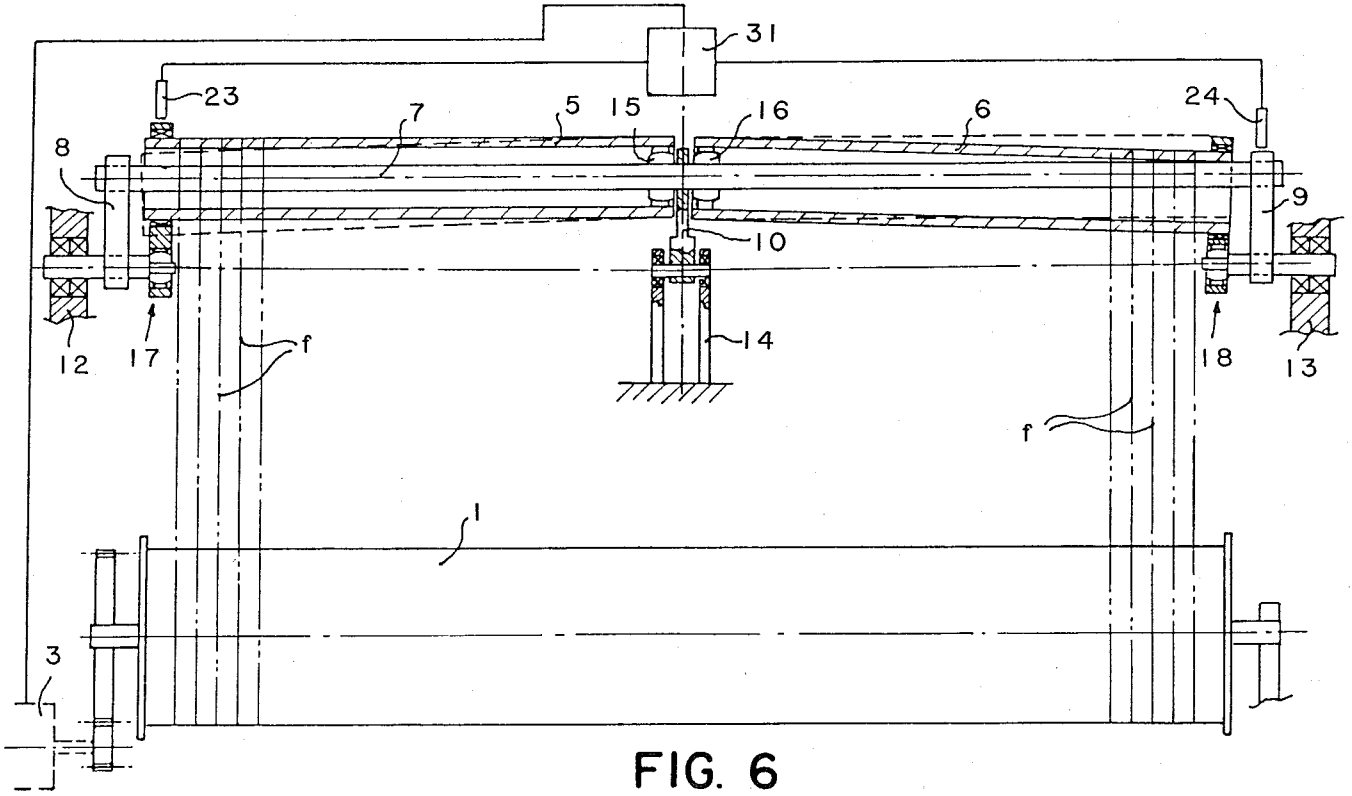
FIG. 6 shows a different embodiment of the arrangement according to the invention, applied in the case of a single beam replacing the twin beams.

FIGS. 4 to 6 show some modified embodiments of the arrangement according to the invention.

FIG. 4 shows how the return means for the levers 8 and 9 may comprise—instead of a spring 21—a positive control, consisting of a pair of toggle-joint levers 25 and 26 and of a cam 27 acting on said pair of levers. Whereas, the supports 17 and 18 (see FIGS. 4 and 5) can be controlled by means of hydraulic cylinders 28 and 29, the action of which is balanced thanks to their connection to a central cylinder 30 which regulates the strength of said action. In this case, unwinding takes place merely thanks to the changes of inclination of the yarn carriers 5 and 6.

FIG. 6 shows finally the system according to the invention, applied in the case of using a single beam 1: there are again two yarn carriers 5 and 6, mounted as in the previous arrangement, and two sensors 23 and 24, the signals of which are caused to interact in an electronic circuit 31, so as to obtain signals for controlling the single unwinder 3 of the beam 1. This arrangement allows operating with high warp yarn tensions.

The efficiency of the heretofore described and illustrated arrangements will appear quite evident to the experts in the field, said arrangement allowing operating with a very uniform and constant tension in the warp yarns, while making if possible to regulate the damping action of the yarn carriers and to carry out the various adjustments in a very simple, easy and reliable manner.

I claim:

1. Unwinding device for twin warp beams, with two separate unwinders each driving in rotation a separate beam, comprising two yarn carriers (5, 6) one individual to each said beam (1, 2), means mounting the yarn carriers for swinging movement under the tension of warp yarns (f) which have been unwound from the beams (1, 2) and bear against the yarn carriers (5, 6) sensors (23, 24) individual to said yarn carriers (5, 6) for detecting said swinging movement, means responsive to said sensors to adjust the speed of the two unwinders (3, 4) according to the swinging movement of the yarn carriers (5, 6) said yarn carriers (5, 6) being carried by an oscillating bar (7) and being mounted, at their inward ends, on ball joints (15, 16) allowing rotation and inclination thereof in respect of said bar (7), and at their outward ends on supports (17, 18) that rotate and tilt on ball joints (19, 20) and that are connected to levers (8, 9) supporting said bar (7) and causing the oscillation thereof, calibrated return means opposing the oscillations of said levers (8, 9) and of said supports (17, 18) caused by the tensions of the warp yarns (f), said responsive means comprising sensors (23, 24) that detect the position of some of said supports and levers (8, 9, 17, 18).

2. Unwinding device as in claim 1, wherein said return means consist of calibrated springs (21, 22).

3. Unwinding device as in claim 1, wherein said return means consist of a positive cam control unit (25, 26, 27) for the oscillation of said levers (8, 9), and of fluid pressure means (28, 29) opposing the oscillation of said supports (17, 18).

4. Unwinding device as in claim 3, wherein said fluid pressure means (28, 29) are connected to a device (30) apt to evenly distribute the pressure.

5. Unwinding device for a single warp beam, adopting the arrangement for detecting the warp yarn tensions according to claim 1, with the help of an electronic interaction circuit (31).

* * * * *